US009089193B2

(12) United States Patent
Casini

(10) Patent No.: US 9,089,193 B2
(45) Date of Patent: Jul. 28, 2015

(54) CLASP FOR ORNAMENTAL CHAINS

(71) Applicant: Alberto Casini, Arezzo (IT)

(72) Inventor: Alberto Casini, Arezzo (IT)

( * ) Notice: Subject to any disclaimer, the term of this patent is extended or adjusted under 35 U.S.C. 154(b) by 65 days.

(21) Appl. No.: 13/915,925

(22) Filed: Jun. 12, 2013

(65) Prior Publication Data

US 2014/0000068 A1 Jan. 2, 2014

(30) Foreign Application Priority Data

Jun. 19, 2012 (IT) ..... FI201200038 U

(51) Int. Cl.
*A44C 5/20* (2006.01)

(52) U.S. Cl.
CPC ..... *A44C 5/2071* (2013.01); *A44D 2203/00* (2013.01); *Y10T 24/32* (2015.01)

(58) Field of Classification Search
CPC ... A44D 2203/00; A44C 5/2071; Y10T 24/32
USPC ..... 24/303, 68 J, 574.1; 63/900, 3.1
See application file for complete search history.

(56) References Cited

U.S. PATENT DOCUMENTS

| | | | | |
|---|---|---|---|---|
| 2,975,497 | A * | 3/1961 | Budreck | 24/303 |
| 3,111,736 | A * | 11/1963 | Budreck | 24/303 |
| 5,197,168 | A * | 3/1993 | Levy | 24/303 |
| 5,448,806 | A * | 9/1995 | Riceman et al. | 24/303 |
| 6,226,842 | B1 * | 5/2001 | Wong | 24/303 |
| 6,378,174 | B1 * | 4/2002 | Wong | 24/303 |
| 7,178,207 | B2 * | 2/2007 | Wong et al. | 24/303 |
| 7,207,091 | B2 * | 4/2007 | Dunaye | 24/303 |

* cited by examiner

*Primary Examiner* — Victor Batson
*Assistant Examiner* — Abigail Morrell
(74) *Attorney, Agent, or Firm* — Lucas & Mercanti, LLP

(57) ABSTRACT

A magnetic clasp for bracelets or chains is disclosed. The clasp has a male element and a female element adapted to be engaged with one another and each has respective links for securing the elements to respective ends of a chain structure. Each of the elements is cup-shaped and has a cavity for the containment of a magnet adapted to exert a magnetic attraction for stably locking the male and female elements to each other. The clasp also includes a shield made of ferromagnetic material arranged inside the cavities.

10 Claims, 3 Drawing Sheets

CLASP FOR ORNAMENTAL CHAINS

CROSS-REFERENCE TO RELATED APPLICATION

This application claims the benefit of Italian Patent Application No. FI2012U000038, filed Jun. 19, 2012, the contents of which are incorporated herein reference.

FIELD OF THE INVENTION

The present invention refers to the field of jewelry and costume jewelry in general and in particular it concerns a clasp for ornamental chain structures usually for manufacturing bracelets, necklaces and the like. More in detail the present invention refers to a clasp of the magnetic type.

BACKGROUND OF THE INVENTION

A known type of such clasps comprises two elements (male and female) shaped so as to be engageable with one another and provided with connection links for securing to respective ends of the chain. Each of the two elements of the clasp is provided with magnetic means, such as for example a permanent magnet, that are capable of exerting a magnetic attraction with an intensity such as to ensure the stable connection between the elements themselves.

Due to the fact that they are simple to use, versatile and having a simple structure, leading to relatively low production costs, the use of magnetic clasps is widespread and they are object of continuous improvements.

One of the main problems found when using these clasps is related to the intensity of the field generated by the aforementioned magnetic means. As previously mentioned, the reliability of the clasp and the firmness of connection of the elements is increased when there are magnetic fields with greater intensity; however, particularly intense magnetic fields can interact with objects in ferromagnetic material which accidentally come into contact with the clasp, such as coins, jewelry etc. onto which the user wearing the jewel could get caught.

The accidentally approaching to the clasp can also be critical for objects that are particularly sensitive to magnetic fields such as electronic devices (for example microchips, pacemakers, etc.), magnetic cards (credit cards, badges, etc.) which can become irreparably damaged or demagnetised, creating great damage to the user.

In order to attempt to at least partially avoid such drawbacks, solutions have been developed that are aimed at shielding the magnetic field outside the clasp for example by associating shielding means made from ferromagnetic material to the magnetic means. However, such solutions do not solve the problem in a completely satisfactory manner.

SUMMARY OF THE INVENTION

The object of the present invention is therefore to provide a magnetic clasp that solves the problem described above, and in particular that is not dangerous for objects that are particularly sensitive to magnetic fields that accidentally come into contact with it, whilst ensuring good secureness and stability in the connection of the jewel.

Yet a timber object of the present invention is to provide a magnetic clasp that is easy to use, versatile and has a nice appearance.

These objects are achieved with the magnetic clasp for jewelry and costume jewelry ornamental chains the essential characteristics of which are defined by the first of the attached claims.

The invention shall now be illustrated in greater detail with the following description of an embodiment thereof, given as an example and not for limiting purposes, with reference to the attached drawings, in which:

DETAILED DESCRIPTION OF THE INVENTION

Figure 2:
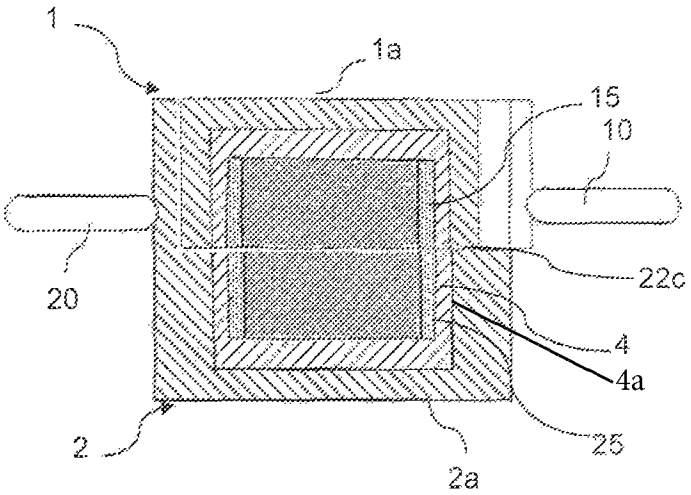
FIG. 2 is again a diametrical section view of the clasp in the locked configuration, that is with the male and female elements that are engaged with one another.
Figure 1:
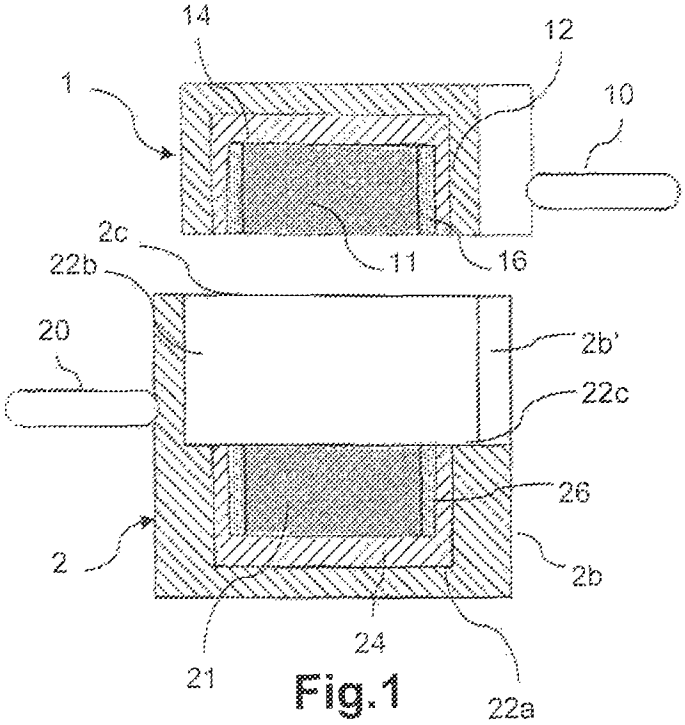
FIG. 1 shows a diametrical section view of the clasp according to the invention in the open configuration, that is with male and female elements that are not connected to one another.
Figure 3:
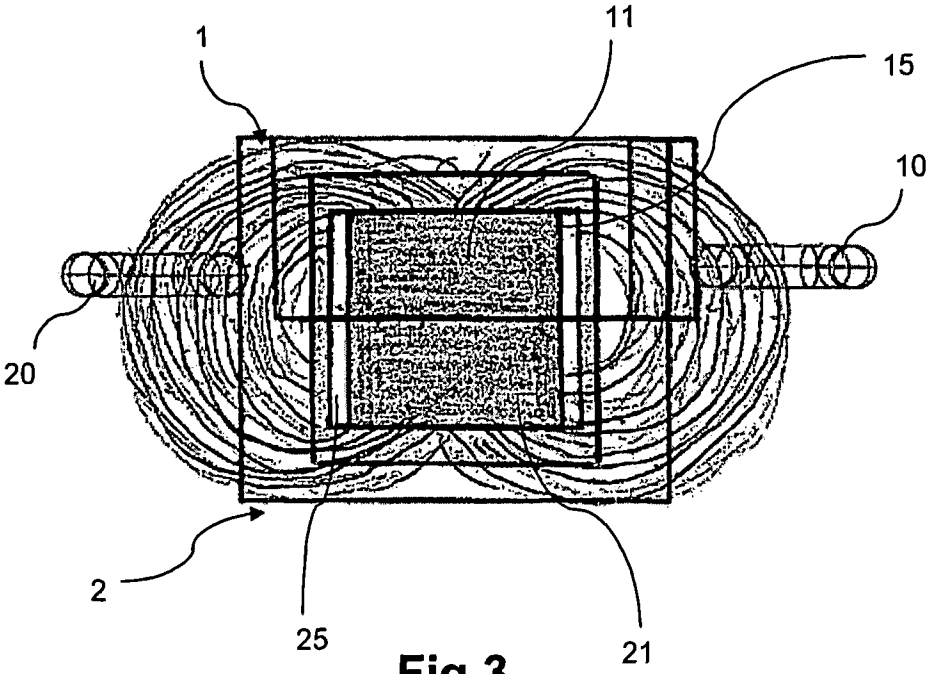
FIG. 3 shows the clasp of FIG. 2 with a schematic depiction of the force lines of the magnetic field generated by magnetic means associated with the same clasp.
Figure 4:
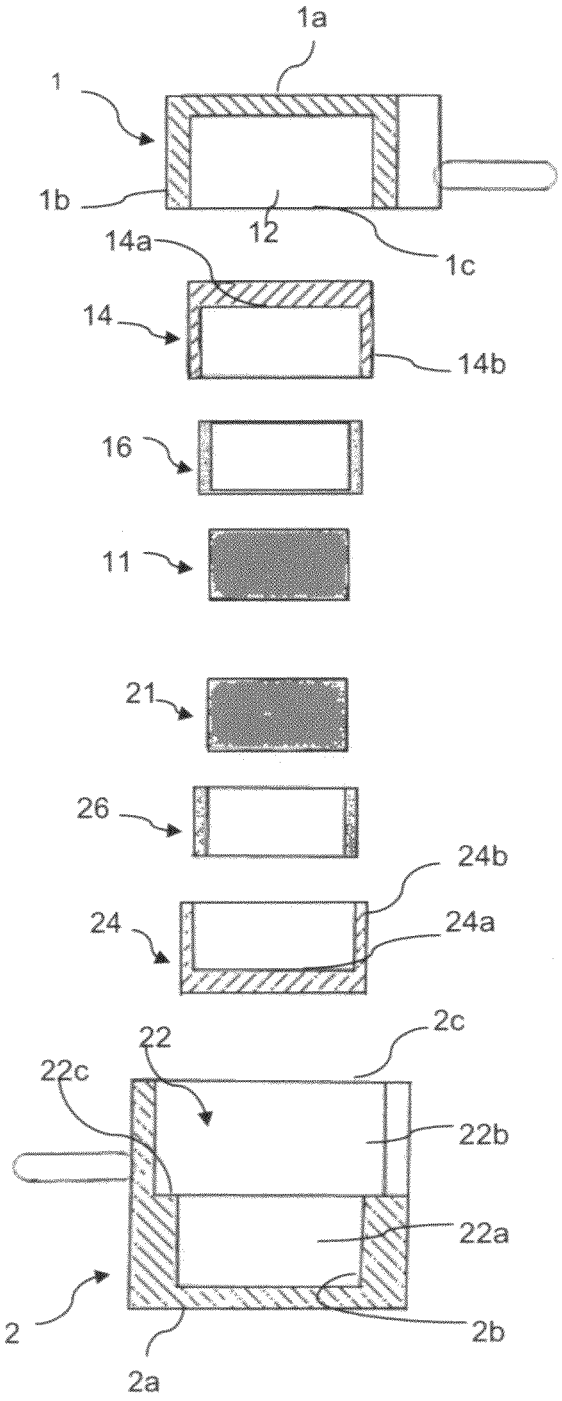
FIG. 4 is an exploded view of the clasp of the previous figures, with each of the elements of the clasp represented in a diametrical section view.

With reference to the aforementioned figures, the magnetic clasp for decorative chain structures for manufacturing bracelets, necklaces and the like comprises a male element 1 and a female element 2 shaped so as to be engaged with one another. The clasp is in an open configuration when the male and female elements are not engaged with one another; in this case the jewel is open so as to allow a user to wear it. When the male and female elements are engaged with one another, on the other hand, the clasp is in the locked configuration; the jewel is this closed when worn by the user.

Each of the male and female elements are provided with connection means, such as a link 10 and 20, respectively, for securing the elements to respective ends of the aforementioned chain (not shown). In the embodiment here described, the link 10, 20 project from an outer wall of the corresponding element. Other types of linkage between each element and the chain can be chosen among the various solutions that are commonly used in the field. The ends of the chain can even be directly welded to the male and female elements of the clasp.

In the present embodiment the male and female elements have a substantially cup-like shape, e.g. a cylindrical one, and become engaged coaxially to one another. However any other shape can be provided as long as the male and female elements can be engaged with one another.

As it can be clearly seen in the figures, the male element 1 has a bottom 1*a* and a side wall 1*b* rising from a periphery of the bottom. Opposite the bottom 1*a* there opens a mouth 1*c*. The side wall defines with the bottom 1*a* a cavity or seat 12 for housing magnetic means (see hereafter).

Analogously, the female element 2 has a cup-like shape. In detail, the female element has a bottom 2*a* and a side wall 2*b* rising from a periphery of the bottom 2*a*; a mouth 2*c* opens opposite to said bottom to define a cavity 22. The mouth 2*c* allows the penetration of the male element inside the female element.

With reference to the cavity 22 of the female element, this comprises two axially superimposed cylindrical portions with different diameters, between which a step 22*c* is defined: a lower portion 22*a* (delimited between the step 22*c* and the bottom 2*a*) and an enlarged upper portion 22*b* (between the step 22*c* and the mouth 2*c*). The step 22*c* acts as an end stop for the male element when it is inserted inside the female element and in particular into the upper portion 22*b*, which is indeed adapted to house the male element when the clasp is in the locked configuration.

In order to allow the insertion of the male element inside the female element so that the first remains flush with the free edge of the wall 2*b* of the second, a break 2*b*' is opened up on the wall 2*b* allowing for the passage of the connection means associated with the male element, that is the connection link 10. The break 2*b*' extends for substantially the entire axial depth of the upper portion 22*b*, up to the step 22*c*.

Alike the seat 12 of the male element, also the lower portion 22*a* contains magnetic means. In particular, the magnetic means are adapted to exert a magnetic attraction having an intensity such as to ensure the stable connection between the elements.

Preferably, the magnetic means are permanent magnets with opposed polarities 11, 21 that are housed in the seat 12 of the male element and in the lower portion 22*a* of the cavity of the female element, respectively. The permanent magnets 11, 21 are preferably, but not necessarily, disc-shaped and are arranged so that respective main faces are flush with the mouths 1*c*, 2*c* of the male and female elements and are adapted to be in mutual contact when the clasp is in the locked configuration.

In order to reduce the intensity of the magnetic field generated by the permanent magnets outside the clasp, shielding means are provided inside the seat 12 and the lower portion 22*a* of the cavity 22. The shielding means comprise a shell 4 defined by two cup-shaped containers 14, 24 that are associated with the male and female element, respectively. The cup-shaped containers 14, 24 are made of ferromagnetic material with dimensions such as to fit perfectly within the seat 12 and the lower portion 22*a* of the cavity 22, respectively.

Each cup-like container in turn has its own bottom 14*a*, 24*a* from which side walls 14*b*, 24*b* rise in a peripheral position and perpendicularly with respect to the same bottom. The side walls of the containers have an axial height so as to completely cover the side walls of the seat 2 of the male element and of the lower portion 22*a* of the cavity of the female element. In this way, when the male and female elements are engaged with one another, a continuous side wall 4*a* of the shell 4 is defined (FIG. 2).

Each magnet 11, 21 is accommodated inside the respective container in a spaced position from the side wall 4*a*, so as to define with it an annular gap 15, 25. Ring-like spacers 16, 26 made from non-magnetic material are fit within the respective gaps 15, 25 of the aforementioned cup-shaped containers, and contribute to the shielding of the magnetic field.

The ring-like spacers 16, 26 have a constant radial thickness that is preferably lower than half the axial width of the disc-shaped magnet. The non-magnetic materials preferably used are rubber, plastic, brass but also the use of simple air should not be excluded. In such a case the spacer means consist in the volume of air contained inside the gap.

The shielding means described above, in association with the spacers, thus make it possible to shield the magnetic field so that the intensity thereof outside the clasp is substantially null or at least negligible and the clasp does not attract ferromagnetic objects that could accidentally come into contact with it.

The clasp according to the invention is therefore also secure for objects that are sensitive to the presence of magnetic fields such as electronic devices, magnetic cards, badges, etc.

Even with this result the clasp still maintains an unvaried simplicity of use and pleasant appearance, so that it can also be inserted in quite precious jewels. Moreover, it is extremely versatile considering that different geometrical solutions can be made use of, providing for example male and female elements with a different peripheral shape (such as a heart, a star etc.) within which seats/cavities (preferably cylindrical or polygonal) are formed for containing the magnetic means. This makes it possible to adapt the shape of the clasp to the overall style of the jewel or to other decorative, elements, so that the clasp is perfectly integrated in the jewel.

Each magnet can be fixed to its cup-shaped container through simple gluing, or snap-fitting, or other known methods that are obvious to a man skilled in the art and thus not described in detail.

Even if in the preferred embodiment two permanent magnets are used, alternative solutions are however possible in which there is only one permanent magnet interacting with a ferromagnetic body housed in the female element and in the male element, respectively, or vice versa. The invention is in fact not limited to the embodiment described and illustrated above, but comprises any variant embodiment.

The invention claimed is:

1. A magnetic clasp for an ornamental chain structure for bracelets or necklaces, the clasp comprising a male element and a female element adapted to be engaged with one another each comprising respective links for securing the elements to respective ends of said chain structure, each of the elements being cup-shaped and defining cavities for the containment of magnetic means adapted to exert a magnetic attraction for stably locking the male and female elements to each other, the clasp further comprising shielding means arranged inside each of the cavities, each of the shielding means being made of ferromagnetic material to shield the magnetic field generated by the magnetic means and being cup-shaped with a sidewall, the shielding means respectively fitting within the cavities, the magnetic means being arranged inside each of said shielding means in a spaced position from the respective side wall of the shielding means so as to define respective ring-shaped gaps between the magnetic means and the side wall of the each of the shielding means, wherein the cavity of the female element comprises two portions superimposed on each other with a different diameter, of which a lower portion and an enlarged upper portion, said lower portion accommodating the respective shielding means, said upper portion being adapted to house said male element when said elements are engaged with one another in a clasp locking configuration;

between said upper portion and said lower portion a step is defined which acts as an end stop for said male element when the male element is inserted inside said female element; and the upper portion of the cavity of the female element comprises a side wall with a break allowing the passage of the link associated with the male element whereby the male element becomes inserted in the female element in the locking configuration, with the male element remaining flush with a free edge of the side wall of the female element, said break extending substantially for the entire axial depth of the upper portion, up to said step.

2. The magnetic clasp according to claim 1, further comprising ring-shaped spacers made from non-magnetic material, arranged within the respective ring-shaped gaps.

3. The magnetic clasp according to claim 2, wherein said spacers have a constant radial thickness.

4. The magnetic clasp according to claim 2, wherein the non-magnetic material for the ring-shaped spacers is selected from the group consisting of rubber, plastic and brass.

5. The magnetic clasp according to claim 2, wherein the magnetic means includes a disc shaped magnet.

6. The magnetic clasp of claim 5, wherein said spacers have a constant radial thickness that is less than half the axial width of the disc-shaped magnet.

7. The magnetic clasp according to claim 1, wherein said magnetic means comprise at least one permanent magnet housed either inside the cavity of the male element or the lower portion of the cavity of the female element.

8. The magnetic clasp according to claim 7, wherein said at least one permanent magnet includes two permanent magnets with opposite polarities respectively associated with the male element and with the female element.

9. The magnetic clasp according to claim 7, wherein said at least one permanent magnet includes a permanent magnet and a ferromagnetic element respectively associated with the male element and with the female element.

10. The magnetic clasp according to claim 1, wherein said male and female elements are cylindrical.

* * * * *